US009587618B2

(12) United States Patent
Ikeda et al.

(10) Patent No.: US 9,587,618 B2
(45) Date of Patent: Mar. 7, 2017

(54) SPARK IGNITION INTERNAL COMBUSTION ENGINE

(75) Inventors: Yuji Ikeda, Kobe (JP); Atsushi Nishiyama, Kobe (JP); Takeshi Serizawa, Ikeda (JP); Hiroaki Oi, Ikeda (JP)

(73) Assignee: IMAGINEERING, INC., Kobe-shi (JP)

( * ) Notice: Subject to any disclaimer, the term of this patent is extended or adjusted under 35 U.S.C. 154(b) by 56 days.

(21) Appl. No.: 14/129,692

(22) PCT Filed: Jul. 4, 2012

(86) PCT No.: PCT/JP2012/067083

§ 371 (c)(1),
(2), (4) Date: Mar. 27, 2014

(87) PCT Pub. No.: WO2013/005772

PCT Pub. Date: Jan. 10, 2013

(65) Prior Publication Data

US 2014/0224203 A1 Aug. 14, 2014

(30) Foreign Application Priority Data

Jul. 4, 2011 (JP) ..... 2011-148396

(51) Int. Cl.
*F02B 9/00* (2006.01)
*F02P 23/04* (2006.01)
(Continued)

(52) U.S. Cl.
CPC ..... *F02P 23/045* (2013.01); *F02P 3/01* (2013.01); *F02P 23/04* (2013.01); *F02B 1/04* (2013.01); *F02P 9/007* (2013.01); *H01T 13/50* (2013.01)

(58) Field of Classification Search
CPC ..... F02P 23/04; F02P 9/007; F02P 23/045; H01T 13/50; F02B 1/04
(Continued)

(56) References Cited

U.S. PATENT DOCUMENTS 7,182,076 B1 * 2/2007 Minker ..... 123/606
2011/0030660 A1 2/2011 Ikeda

FOREIGN PATENT DOCUMENTS

EP 2264306 A1 12/2010
JP 2001-73920 A 3/2001
(Continued)

OTHER PUBLICATIONS

International Search Report for PCT/JP2012/067083, Mailing Date of Nov. 6, 2012.

*Primary Examiner* — Lindsay Low
*Assistant Examiner* — Charles Brauch
(74) *Attorney, Agent, or Firm* — Westerman, Hattori, Daniels & Adrian, LLP

(57) ABSTRACT

An spark ignition type internal combustion engine allows the spark discharge by the ignition plug to react with the electric field created in the combustion chamber and generates the plasma, thereby igniting the fuel air mixture to reduce the emission of the unburned fuel and to improve fuel efficiency of the internal combustion engine in a spark ignition type internal combustion engine that allows an electric field created in a combustion chamber to react with a spark discharge by an ignition plug and generates plasma, thereby igniting fuel air mixture. The engine includes an electromagnetic wave emission device that emits an electromagnetic wave in the combustion chamber when the fuel air mixture is combusted, and a protruding member protrud-
(Continued)

ing from a partitioning surface that partitions the combustion chamber. At least a part of the protruding member is made of a conductor.

8 Claims, 6 Drawing Sheets

(51) Int. Cl.

| | |
|---|---|
| ***F02P 3/01*** | (2006.01) |
| *F02B 1/04* | (2006.01) |
| *H01T 13/50* | (2006.01) |
| *F02P 9/00* | (2006.01) |

(58) Field of Classification Search
USPC ..... 123/143 B
See application file for complete search history.

(56) References Cited

FOREIGN PATENT DOCUMENTS

| | | | |
|---|---|---|---|
| JP | 2008-82286 | A | 4/2008 |
| JP | 2011-007155 | A | 1/2011 |
| JP | 2011-7163 | A | 1/2011 |
| WO | 2009/113692 | A1 | 9/2009 |

* cited by examiner

SPARK IGNITION INTERNAL COMBUSTION ENGINE

TECHNICAL FIELD

The present invention relates to a spark ignition type internal combustion engine that allows an electric field created in a combustion chamber to react with a spark discharge by an ignition plug and generates plasma, thereby igniting fuel air mixture.

BACKGROUND ART

Conventionally, there is known a spark ignition type internal combustion engine that allows an electric field created in a combustion chamber to react with a spark discharge by an ignition plug and generates plasma, thereby igniting fuel air mixture. This type of an internal combustion engine allows the spark discharge to react with the electric field and generates the plasma for the purpose of achieving a good ignition. For example, Japanese Unexamined Patent Application, Publication No. 2011-7155 discloses an internal combustion engine of this type.

The internal combustion engine disclosed in Japanese Unexamined Patent Application, Publication No. 2011-7155 creates an electric field by means of a microwave and allows the electric field to react with a spark discharge. The spark discharge by an ignition plug turns into plasma in the electric field. A flame kernel, which serves as a trigger of flame propagation combustion, is enlarged in comparison with an ignition by a spark discharge alone.

THE DISCLOSURE OF THE INVENTION

Problems to be Solved by the Invention

With the conventional spark ignition type internal combustion engine, it is possible to reduce pumping loss, and thus, improve fuel efficiency by leaning a fuel air mixture. However, as the fuel air mixture is made leaner, a propagation speed of a flame decreases, thereby resulting in an increase of unburned fuel emission. Although the fuel efficiency is improved owing to the reduction of pumping loss, the improvement of fuel efficiency of the internal combustion engine is degraded due to increase in unburned fuel.

The present invention has been made in view of the above described problems, and it is an object of the present invention to reduce the emission of unburned fuel and to improve fuel efficiency of an internal combustion engine in a spark ignition type internal combustion engine that allows an electric field created in a combustion chamber to react with a spark discharge by an ignition plug and generates plasma, thereby igniting fuel air mixture.

Means for Solving the Problems

In accordance with a first aspect of the present invention, there is provided a spark ignition type internal combustion engine that allows an electric field created in a combustion chamber to react with a spark discharge by an ignition plug and generates plasma, thereby igniting fuel air mixture. The spark ignition type internal combustion engine includes an electromagnetic wave emission device that emits an electromagnetic wave in the combustion chamber when the fuel air mixture is combusted, and a protruding member protruding from a partitioning surface that partitions the combustion chamber, wherein at least apart of the protruding member is made of a conductor.

According to the first aspect of the present invention, the electromagnetic wave emission device emits the electromagnetic wave to the combustion chamber when the fuel air mixture is combusted. Then, the electromagnetic wave causes an induced current to flow in the conductor of the protruding member, an electric field concentrates on the vicinity of the protruding member, and the plasma is generated in the vicinity of the protruding member. According to the first aspect of the present invention, the plasma is generated elsewhere than a region in which the spark discharge reacts with the electric field.

In accordance with a second aspect of the present invention, in addition to the first aspect of the present invention, the electromagnetic wave emission device emits the electromagnetic wave when the spark discharge occurs.

According to the second aspect of the present invention, since the electromagnetic wave emission device emits the electromagnetic wave when the spark discharge occurs, the plasma is more effectively generated in the vicinity of the protruding member at a timing when the plasma is generated by the reaction of the spark discharge with the electric field.

In accordance with a third aspect of the present invention, in addition to the first or second aspect of the present invention, the electromagnetic wave emission device emits the electromagnetic wave after the fuel air mixture is ignited by the plasma generated by the reaction of the spark discharge with the electric field.

According to the third aspect of the present invention, the plasma is more effectively generated in the vicinity of the protruding member after the fuel air mixture is ignited owing to the reaction of the spark discharge with the electric field.

In accordance with a fourth aspect of the present invention, in addition to the first, second, or third aspect of the present invention, the protruding member is arranged in a region where propagation speed of a frame is relatively slow in the combustion chamber, wherein the frame spreads from a location where the plasma is generated as a result of a reaction of the spark discharge with the electric field.

According to the fourth aspect of the present invention, the protruding member is arranged in the region in which the flame is propagated at a relatively slow speed in the combustion chamber. As a result thereof, the plasma is generated by the electric field that concentrates on the protruding member in the region in which the flame is propagated at a relatively slow speed in the combustion chamber.

In accordance with a fifth aspect of the present invention, in addition to any one of the first to fourth aspects of the present invention, the conductor of the protruding member is constituted by a metal wire having a length of one quarter wavelength of the electromagnetic wave emitted by the electromagnetic wave emission device.

According to the fifth aspect of the present invention, since the conductor of the protruding member is configured by the metal wire having a length of one quarter wavelength of the electromagnetic wave emitted to the combustion chamber, it is possible to effectively concentrate the electric field on the protruding member.

In accordance with a sixth aspect of the present invention, in addition to any one of the first to fifth aspects of the present invention, a plurality of the protruding members are arranged on the partitioning surface at an interval of one quarter wavelength or less of the electromagnetic wave emitted by the electromagnetic wave emission device.

According to the sixth aspect of the present invention, it is possible to further increase the electric field intensity by configuring such that the plurality of the protruding members are arranged at an interval of one quarter wavelength or less of the electromagnetic wave emitted to the combustion chamber.

In accordance with a seventh aspect of the present invention, in addition to any one of the first to sixth aspects of the present invention, the combustion chamber is formed in a cylinder in the form of a cylindrical shape, and the ignition plug which causes the spark discharge to occur is arranged at a central part of a ceiling surface of the combustion chamber, while the protruding member is arranged between the ignition plug and a wall surface of the combustion chamber on the ceiling surface of the combustion chamber.

According to the seventh aspect of the present invention, the ignition plug is arranged at the central part of the ceiling surface of the combustion chamber, and the protruding member is arranged between the ignition plug and the wall surface of the combustion chamber. The plasma is generated in the vicinity of the ignition plug and in the vicinity of the protruding member more outwardly than the ignition plug.

Effect of the Invention

According to the present invention, when the fuel air mixture is combusted, the electric field of the electromagnetic wave is concentrated on the vicinity of the protruding member that protrudes from the partitioning surface of the combustion chamber so that the plasma is generated elsewhere than a region in which the spark discharge reacts with the electric field. In a region where the plasma is generated, oxidation reaction of the fuel air mixture is promoted and the combustion is accelerated. Accordingly, it is possible to decrease the emission of the unburned fuel and to improve fuel efficiency of the internal combustion engine.

BEST MODE FOR CARRYING OUT THE INVENTION

In the following, a detailed description will be given of the embodiment of the present invention with reference to drawings. It should be noted that the following embodiment is a mere example that is essentially preferable, and is not intended to limit the scope of the present invention, applied field thereof, or application thereof.

Embodiment

The present embodiment is directed to a spark ignition type internal combustion engine (hereinafter, referred to as an "internal combustion engine") 10 that ignites fuel air mixture by means of plasma generated by reaction of a spark discharge with an electric field of a microwave. The internal combustion engine 10 is provided with an internal combustion engine main body 11 formed with a combustion chamber 20, and an ignition device 30 that ignites fuel air mixture in the combustion chamber 20 by means of the plasma.

Internal Combustion Engine Main Body

Figure 1:
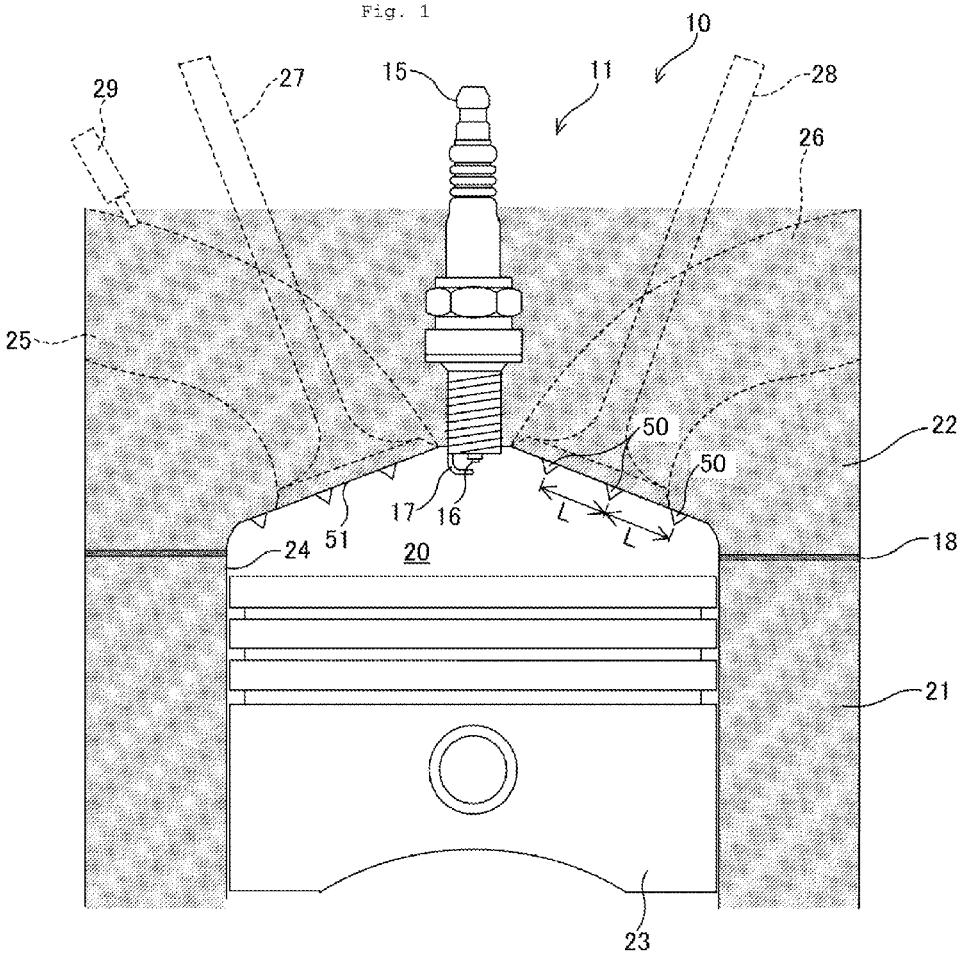
FIG. 1 is a schematic configuration diagram of a spark ignition type internal combustion engine according to an embodiment.

As shown in FIG. 1, the internal combustion engine main body 11 is provided with a cylinder block 21, a cylinder head 22, and pistons 23. The cylinder block 21 is formed with a plurality of cylinders 24 each having a circular cross section. Inside of each cylinder 24, the piston 23 is reciprocatably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocating movement of the piston 23 into rotational movement of the crankshaft.

The cylinder head 22 is placed on the cylinder block 21, and a gasket 18 intervenes between the cylinder block 21 and the cylinder head 22. The cylinder head 22 partitions the combustion chamber 20 along with the cylinder 24 and the piston 23. A protruding member 50, which will be described later, is provided on a partitioning surface. The partitioning surface is constituted by a surface from among surfaces of the cylinder head 22, the cylinder 24, and the piston 23.

The cylinder head 22 is provided with one spark plug 15 that constitutes a part of the ignition device 30 for each cylinder 24. The spark plug 15 is provided at a central part of a ceiling surface 51 of the combustion chamber 20 (a surface that partitions the combustion chamber 20 of the cylinder head 22). The ignition plug 15 is provided at a tip end thereof with a central electrode 16 and a ground electrode 17 which collectively constitute a discharge gap.

The cylinder head 22 is formed with intake ports 25 and exhaust ports 26 for each cylinder 24. Each intake port 25 is provided with an intake valve 27 for opening and closing an opening 25*a* of the intake port 25, and a fuel injection valve 29 for injecting fuel. On the other hand, each exhaust port 26 is provided with an exhaust valve 28 for opening and closing an opening 26*a* of the exhaust port 26.

Figure 2:
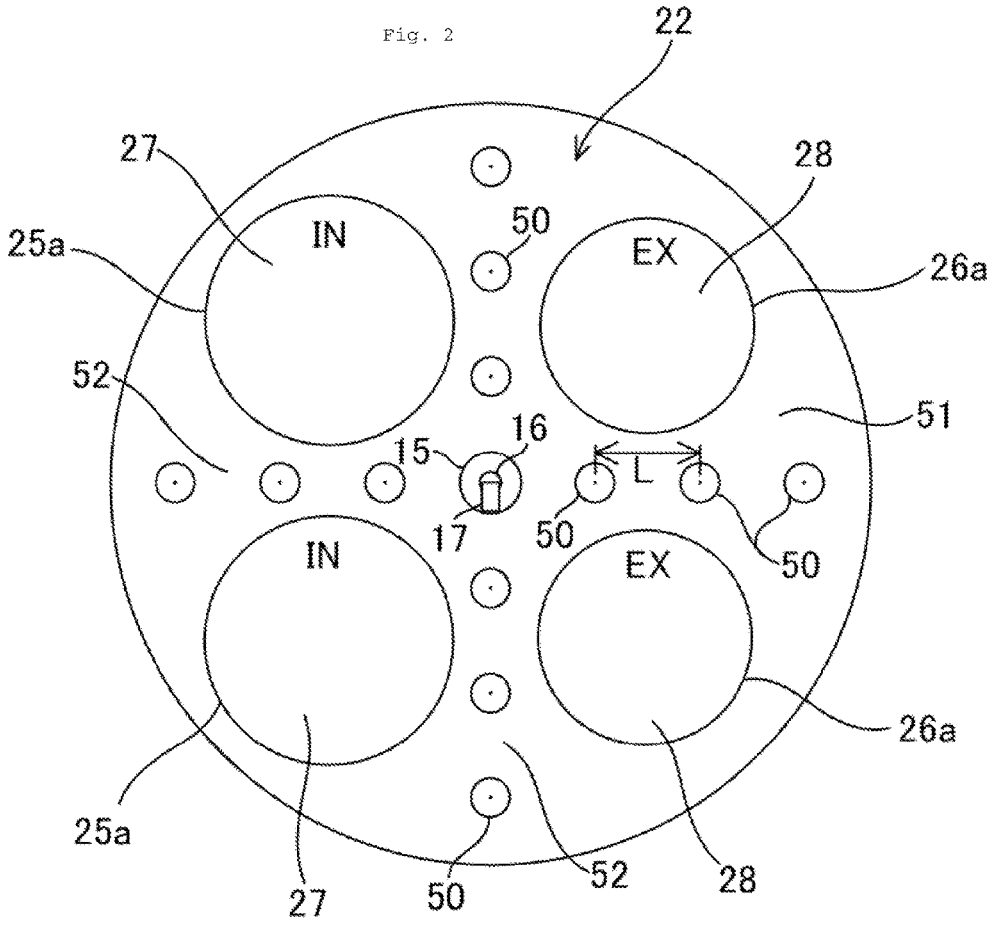
FIG. 2 is a front view of a ceiling surface of a combustion chamber of the spark ignition type internal combustion engine according to the embodiment.

According to the present embodiment, a plurality of the protruding members 50 are provided on the ceiling surface 51 of the combustion chamber 20 in the cylinder head 22. As shown in FIG. 2, on the ceiling surface 51 of the combustion chamber 20, the plurality of the protruding members 50 (three protruding members 50 in the present embodiment) are provided in each inter-port region 52 formed between adjacent openings from among openings 25*a* of the intake ports 25 and openings 26*a* of the exhaust ports 26. In each inter-port region 52, the plurality of the protruding members 50 are equidistantly arranged in a radial direction of the combustion chamber 20. A distance L between tip ends of adjacent protruding members 50 is configured to be a value of one quarter or less of a wavelength $\lambda$ (such as $\lambda/16$) of the microwave emitted to the combustion chamber 20. Each protruding member 50 is formed in a shape of a cone. Each protruding member 50 is entirely constituted by a conductor.

The internal combustion engine 10 is designed such that the intake ports 25 form a strong tumble flow in the combustion chamber 20. In the combustion chamber 20, the fuel air mixture that has flowed in from the intake ports 25 flows along the ceiling surface of the combustion chamber 20 toward a side of the exhaust ports 26. This flow hits a wall surface of the cylinder 24 and a top surface of the piston 23, and consequently forms a swirl rotating in a vertical direction. The tumble flow is formed throughout the intake stroke and the compression stroke.

Ignition Device

Figure 3:
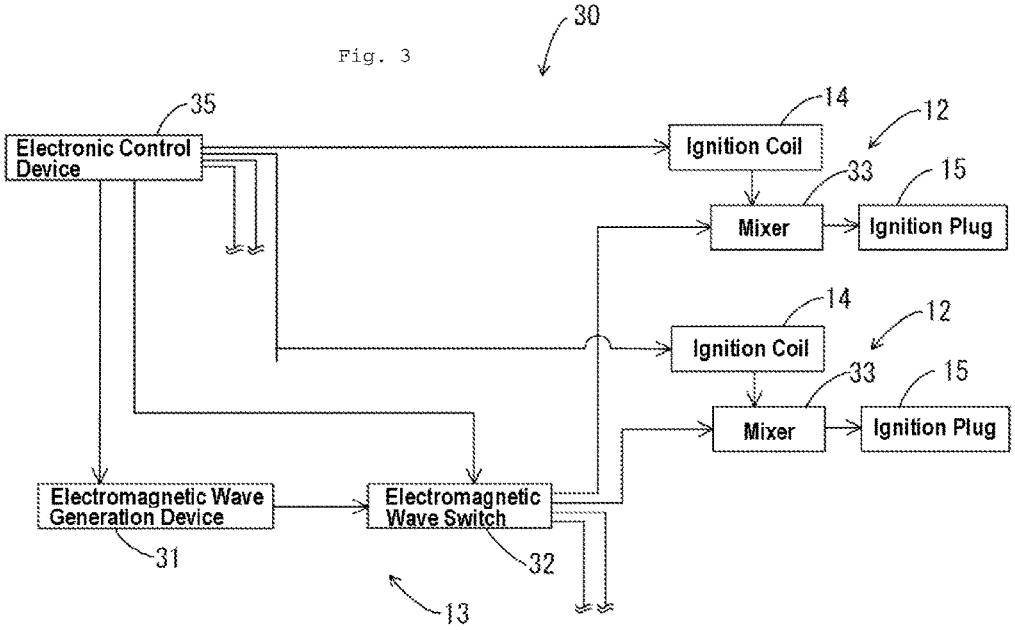
FIG. 3 is a block diagram of an ignition device according to the embodiment.

As shown in FIG. 3, the ignition device 30 is provided with discharge devices 12, an electromagnetic wave emission device 13, and mixers 33. The ignition device 30 generates microwave plasma by allowing the spark discharge generated by the discharge device 12 to react with the microwave emitted by the electromagnetic wave emission device 13.

More particularly, the discharge device 12 is provided for each combustion chamber 20. The discharge device 12 includes an ignition coil 14 that outputs a high voltage pulse and the ignition plug 15 that causes a discharge to occur when applied with the high voltage pulse from the ignition coil 14.

The ignition coil 14 is connected to a direct current power supply (not shown). The ignition coil 14, upon receiving an ignition signal from an electronic control unit 35, boosts a voltage applied from the direct current power supply, and outputs the boosted high voltage pulse to the ignition plug 15. The ignition plug 15 is supplied with the high voltage pulse via the mixer 33. The ignition plug 15, when supplied with the high voltage pulse, causes a spark discharge to occur at the discharge gap.

The electromagnetic wave emission device 13 includes an electromagnetic wave generation device 31, an electromagnetic wave switch 32, and emission antennae 16. According to the present embodiment, the central electrode 16 of the ignition plug 15 functions as the emission antenna 16. One electromagnetic wave generation device 31 and one electromagnetic wave switch 32 are provided for each electromagnetic wave emission device 13, and the emission antenna 16 is provided for each combustion chamber 20.

The electromagnetic wave generation device 31, upon receiving an electromagnetic wave drive signal from the electronic control device 35, repeatedly outputs a microwave pulse at a predetermined duty cycle. The electromagnetic wave drive signal is a pulse signal and the electromagnetic wave generation device 31 repeatedly outputs the microwave pulse during a period of time of the pulse width of the electromagnetic wave drive signal. In the electromagnetic wave generation device 31, a semiconductor oscillator generates the microwave pulse. In place of the semiconductor oscillator, any other oscillator such as a magnetron may be employed.

The electromagnetic wave switch 32 includes an input terminal and a plurality of output terminals provided for respective emission antennae 16. The input terminal is connected to the electromagnetic wave generation device 31. Each output terminal is connected to the corresponding emission antenna 16. The electromagnetic wave switch 32 switches the antenna to be supplied with the microwave outputted from the electromagnetic wave generation device 31 from among the plurality of emission antennae 16. The electromagnetic wave switch 32 is controlled by the electronic control device 35.

The mixer 33 receives the high voltage pulse from the ignition coil 14 and the microwave pulse from the electromagnetic wave generation device 31 via different input terminals and outputs the high voltage pulse and the microwave pulse to the ignition plug 15 from the same output terminal.

Ignition Operation

The operation of the ignition device 30 will be described hereinafter. In the following, the operation of the ignition device 30 will be described for one cylinder 24.

In the cylinder 24, immediately before the piston 23 reaches the top dead center, the intake stroke starts, and immediately after the piston 23 passes the top dead center, the exhaust stroke ends. The electronic control device 35 outputs an injection signal to a fuel injection valve 29 corresponding to the cylinder 24 in the intake stroke so as to cause the fuel injection valve 29 to inject fuel.

After the fuel injection, the intake stroke ends immediately after the piston 23 passes the bottom dead center. When the intake stroke ends, the compression stroke starts. The electronic control device 35 outputs the ignition signal to the ignition coil 14 corresponding to the cylinder 24 in the compression stroke immediately before the piston 23 reaches the top dead center. As a result of this, the high voltage pulse outputted from the ignition coil 14 is supplied to the ignition plug 15, and the spark discharge occurs at the discharge gap of the ignition plug 15.

The electronic control device 35 also outputs the electromagnetic wave drive signal to the electromagnetic wave generation device 31 immediately before the high voltage pulse is outputted from each ignition coil 14. Prior to the output of the electromagnetic wave drive signal, the electromagnetic wave switch 32 has already switched a supply destination of the microwave to the central electrode 16 of the ignition plug 15 that is to receive the high voltage pulse. As a result of this, the microwave pulse outputted from the electromagnetic wave generation device 31 is emitted to the combustion chamber 20 from the central electrode 16 of the ignition plug 15 that receives the high voltage pulse. The microwave pulse is repeatedly emitted during a period from immediately before to immediately after the spark discharge is generated.

The spark discharge is enlarged by reacting with the electric field of the microwave pulse. As a result of this, comparatively large microwave plasma is generated. On the other hand, the electric field of the microwave pulse concentrates not only on the vicinity of the central electrode 16 which serves as the emission antenna but also on the vicinity of each protruding member 50. As a result of this, the microwave plasma is also generated in the vicinity of each protruding member 50. In the combustion chamber 20, the fuel air mixture is ignited at multiple points by the microwave plasma, and thus, the combustion of the fuel air mixture is initiated.

In the cylinder 24, the piston 23 is moved toward a side of the bottom dead center by the expansion force when the fuel air mixture combusts, and the exhaust stroke starts immediately before the piston 23 reaches the bottom dead center. As described above, the exhaust stroke ends immediately after the intake stroke starts.

Effect of Embodiment

According to the present embodiment, when the fuel air mixture is combusted, the electric field of the microwave is concentrated on the vicinity of each protruding member 50 that protrudes from the ceiling surface 51 of the combustion chamber 20 so that the microwave plasma can be generated elsewhere than the region in which the spark discharge reacts with the electric field. In the region where the microwave plasma is generated, the oxidation reaction of the fuel air mixture is promoted, and the combustion is accelerated. Accordingly, it is possible to reduce the emission of the unburned fuel and to improve fuel efficiency of the internal combustion engine 10.

First Modified Example of Embodiment

According to the first modified example, the electromagnetic wave emission device 13 emits the microwave after the fuel air mixture is ignited by the plasma generated by the reaction of the spark discharge with the electric field. The ignition device 30 generates plasma in the vicinity of the ignition plug 15 by allowing the spark discharge to react with an electric field of a high frequency wave at a frequency lower than the microwave.

Figure 4:
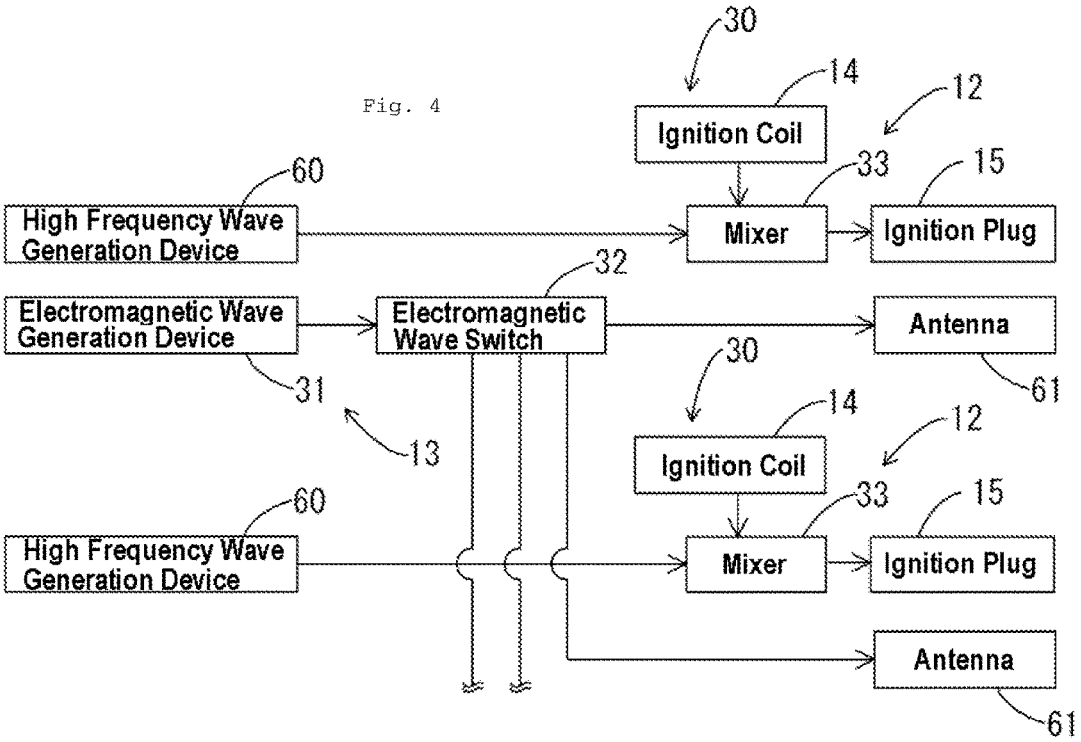
FIG. 4 is a block diagram of an ignition device and an electromagnetic wave emission device according to a first modified example of the embodiment.
Figure 5:
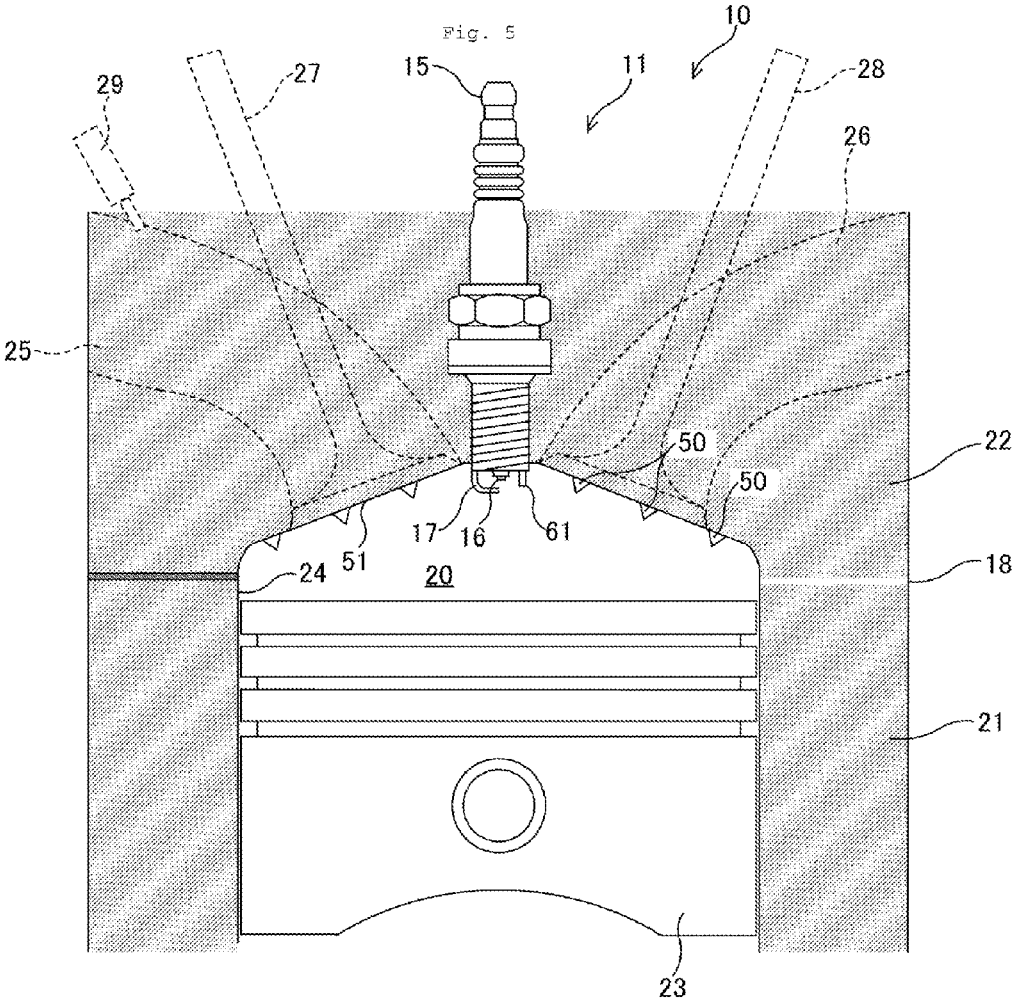
FIG. 5 is a schematic configuration diagram of a spark ignition type internal combustion engine according to the first modified example of the embodiment.
Figure 6:
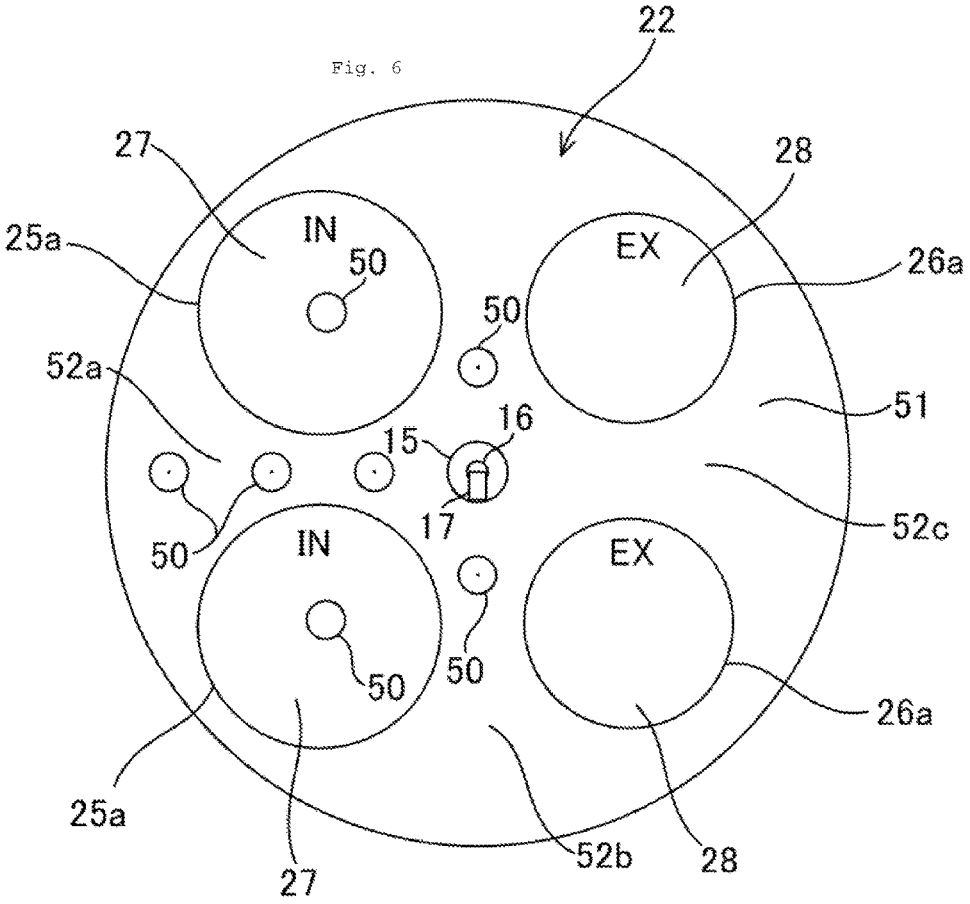
FIG. 6 is a front view of a ceiling surface of a combustion chamber of a spark ignition type internal combustion engine according to a second modified example of the embodiment.

More particularly, as shown in FIG. 4, the ignition device 30 includes the discharge devices 12 and high frequency generation devices 60. The high frequency generation device 60 outputs a high frequency wave of high voltage at the same time as the ignition coil 14 outputs the high voltage pulse. The high frequency wave of high voltage is supplied to the ignition plug 15 via the mixer 33. At the discharge gap of the ignition plug 15, comparatively large plasma is generated by the reaction of the spark discharge with the electric field of the high frequency wave, and the plasma ignites the fuel air mixture.

Unlike the embodiment described above, the electromagnetic wave emission device 13 does not constitute a part of the ignition device 30. The electromagnetic wave emission device 13 includes the electromagnetic wave generation device 31, the electromagnetic wave switch 32, and emission antennae 61. The electromagnetic wave generation device 31 and the electromagnetic wave switch 32 are the same as those described in the embodiment described above. According to the first modified example, the ignition plug 15 is provided at a tip end thereof with the emission antenna 61 separately from the central electrode 16 of the ignition plug 15. A microwave transmission line (not shown) that connects between the electromagnetic wave switch 32 and the emission antenna 61 is provided so as to penetrate through an outer conductor of the ignition plug 15. The emission antenna 61 may be provided at a location (such as the ceiling surface 51 of the combustion chamber 20) other than the ignition plug 15.

The electromagnetic wave emission device 13 emits the microwave after the fuel air mixture is ignited by the plasma generated by the ignition device 30. The electromagnetic wave emission device 13 emits the microwave before a flame spreading from an ignition location of the ignition device 30 passes through the protruding member 50 that is closest to the ignition plug 15. As a result of this, the microwave causes an induced current to flow through a conductor of each protruding member 50, the electric field concentrates on the vicinity of each protruding member 50, and the microwave plasma is generated in the vicinity of each protruding member 50. In a region where the microwave plasma is generated, the oxidation reaction of the fuel air mixture is promoted, and the combustion is accelerated. This means that a propagation speed of the flame spreading from the discharge gap is improved by the microwave plasma. According to the first modified example, it is possible to reduce the emission of the unburned fuel and to improve fuel efficiency of the internal combustion engine. The electromagnetic wave emission device 13 continues to emit the microwave until the flame spreading from the ignition location of the ignition device 30 passes through the protruding member 50 that is most distant from the ignition plug 15.

According to the first modified example, the electromagnetic wave emission device 13 may also emit the microwave when the spark discharge occurs. This means that the microwave may also be emitted when the fuel air mixture is ignited by the plasma generated by the ignition device 30.

Furthermore, the method described in the first modified example may also be applied to the embodiment described above. This means that, in the embodiment described above, the microwave may be further emitted after the fuel air mixture is ignited by the plasmas generated in the vicinity of the central electrode 16 and in the vicinity of each protruding member 50.

Second Modified Example of Embodiment

According to the second modified example, the protruding members 50 are arranged in a region in which the flame spreading from the location where the plasma is generated by the ignition device 30 is propagated at a relatively slow speed in the combustion chamber 20.

More particularly, under an influence of the tumble flow, a speed at which the flame propagates increases toward a side of the openings 26*a* of the exhaust ports 26 and decreases toward a side of the openings 25*a* of the intake ports 25. The protruding members 50 are arranged in an inter-port region 52 (an inter-port region 52*a* on the intake side) between the openings 25*a* of the two intake ports 25 and in inter-port regions 52 (inter-port regions 52*b* between the intake and exhaust sides) between the openings 25*a* of the intake ports 25 and the openings 26*a* of the exhaust ports 26. The number of the protruding members 50 arranged in the inter-port region 52*a* on the intake side is greater than the number of the protruding members 50 arranged in the inter-port region 52*b* between the intake and exhaust sides. The protruding members 50 are not arranged in an inter-port region 52 (an inter-port region 52*c* on the exhaust side) between the openings 26*a* of the two exhaust ports 26. Furthermore, the protruding member 50 is arranged on a surface of a canopy of each intake valve 27 wherein the surface is exposed toward the combustion chamber 20.

According to the second modified example, the plasma is generated in the vicinity of a protruding member 50 in a region in which the flame is propagated at a relatively slow speed in the combustion chamber 20. Accordingly, the flame propagation speed is made uniform in the combustion chamber 20, and thus, it is possible to effectively reduce the emission of the unburned fuel.

Other Embodiments

The embodiment described above may also be configured as follows.

In the embodiment described above, the protruding member 50 may be made of any material as long as a part of the protruding member 50 is made of a conductor. For example, the protruding member 50 may be made of a conical conductor having a surface covered with an insulating layer. In this case, it is possible to improve the durability of the protruding member 50. Furthermore, each protruding member 50 may be made of a conical insulator having a metal wire embedded therein. In this case, it is possible to effectively concentrate the electric field on the protruding member 50 by setting the length of the metal wire to be one quarter wavelength of the microwave emitted to the combustion chamber 20.

Furthermore, in the embodiment described above, each protruding member 50 may be in the form of a shape (such as a column or a wire) other than the cone.

Furthermore, in the embodiment described above, each protruding member 50 may be arranged at a location (such as the top surface of the piston 23) other than the ceiling surface of the combustion chamber 20 from among the partitioning surfaces that partition the combustion chamber 20.

INDUSTRIAL APPLICABILITY

The present invention is useful in relation to a spark ignition type internal combustion engine that allows an electric field created in a combustion chamber to react with a spark discharge by an ignition plug and generates plasma, thereby igniting fuel air mixture.

What is claimed is:

1. A spark ignition type internal combustion engine, comprising:

an electromagnetic wave emission device that emits an electromagnetic wave in the combustion chamber when the fuel air mixture is combusted;

an ignition plug that performs a spark discharge and allows an electric field created with the electromagnetic wave to react with the spark discharge in the combustion chamber, thereby generating plasma therein;

a cylinder head having an intake side at which an intake port is located and an exhaust side at which an exhaust port is located; and a plurality of protruding members protruding from the cylinder head in the combustion chamber so as to generate additional plasma in a vicinity of each protruding member, wherein at least a part of each protruding member is made of a conductor, wherein a flame spreads from a location where the plasma is generated as a result of the reaction of the spark discharge with the electric field, propagation speed of the flame spreading at the intake side in the combustion chamber being slower than propagation speed of the flame spreading at the exhaust side in the combustion chamber, and wherein each protruding member is provided at the intake side or the exhaust side, the number of the protruding members provided at the intake side being greater than the number of the protruding members provided at the exhaust side, thereby generating more plasma on the intake side than the exhaust side so as to increase the propagation speed of the flame on the intake side.

2. The spark ignition type internal combustion engine according to claim 1, wherein the electromagnetic wave emission device emits the electromagnetic wave when the spark discharge occurs.

3. The spark ignition type internal combustion engine according to claim 1, wherein the electromagnetic wave emission device emits the electromagnetic wave after the fuel air mixture is ignited by the plasma generated by the reaction of the spark discharge with the electric field.

4. The spark ignition type internal combustion engine according to claim 1, wherein the conductor of each protruding member is constituted by a metal wire having a length of one quarter wavelength of the electromagnetic wave emitted by the electromagnetic wave emission device.

5. The spark ignition type internal combustion engine according to claim 1, wherein the plurality of the protruding members are arranged on a surface of the cylinder head at an interval of one quarter wavelength or less of the electromagnetic wave emitted by the electromagnetic wave emission device.

6. The spark ignition type internal combustion engine according to claim 1, wherein the combustion chamber is formed in a cylinder in the form of a cylindrical shape, and the ignition plug is arranged at a central part of a ceiling surface of the combustion chamber, while each protruding member is arranged between the ignition plug and a wall surface of the combustion chamber on the ceiling surface of the combustion chamber.

7. The spark ignition type internal combustion engine according to claim 2, wherein the electromagnetic wave emission device emits the electromagnetic wave after the fuel air mixture is ignited by the plasma generated by the reaction of the spark discharge with the electric field.

8. The spark ignition type internal combustion engine according to claim 1, wherein no protruding member is provided at the exhaust side.

* * * * *